US007175467B2

(12) United States Patent
James

(10) Patent No.: US 7,175,467 B2
(45) Date of Patent: Feb. 13, 2007

(54) LOW PROFILE INSULATION DISPLACEMENT CONNECTOR

(75) Inventor: Stephen C. James, San Pedro, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 0 days.

(21) Appl. No.: 11/491,425

(22) Filed: Jul. 21, 2006

(65) Prior Publication Data

US 2006/0258202 A1 Nov. 16, 2006

Related U.S. Application Data

(62) Division of application No. 10/913,669, filed on Aug. 6, 2004, now Pat. No. 7,112,085.

(60) Provisional application No. 60/523,449, filed on Nov. 19, 2003.

(51) Int. Cl.
*H01R 4/24* (2006.01)

(52) U.S. Cl. ..... 439/410

(58) Field of Classification Search ..... 439/410, 439/417, 409, 404, 400
See application file for complete search history.

(56) References Cited

U.S. PATENT DOCUMENTS

| | | | | |
|---|---|---|---|---|
| 3,899,236 | A | 8/1975 | Santos | |
| 4,062,626 | A | 12/1977 | Kawakami et al. | |
| 4,252,395 | A | 2/1981 | Ward et al. | |
| 5,514,006 | A * | 5/1996 | Getselis et al. | 439/417 |
| 5,681,182 | A | 10/1997 | Reichle | |
| 6,080,006 | A | 6/2000 | Broder | |
| 6,196,861 | B1 | 3/2001 | Saligny | |
| 6,231,373 | B1 | 5/2001 | Daoud | |
| 6,537,101 | B1 * | 3/2003 | Wang | 439/417 |
| 6,682,363 | B1 | 1/2004 | Chang | |
| 7,090,529 | B1 * | 8/2006 | Wang | 439/417 |
| 2002/0106929 | A1 * | 8/2002 | Nagai | 439/417 |

* cited by examiner

*Primary Examiner*—Phuong Dinh
(74) *Attorney, Agent, or Firm*—Christie, Parker & Hale, LLP.

(57) ABSTRACT

A lamp and switch assembly with an insulation displacement connector as an insulating base with a pair of wire receiving groups standing walls straddle each of the groups. A pair of insulation displacement connector members has a fixed end secured to the base and a movable end including an insulation displacement slot transfers to the groove. One of the connectors has a switch contact extension which is contacted by a switch contact member electrically connected to one of the lamps. Electrical contact is made to an external insulated wire by flexing the insulation displacement connector to engage the slot with a wire. A pair of opposed ears on the movable end of the connector engages the walls on the base to hold the slot in engagement with the wire.

14 Claims, 3 Drawing Sheets

LOW PROFILE INSULATION DISPLACEMENT CONNECTOR

CROSS-REFERENCE TO RELATED APPLICATION(S)

This U.S. Divisional Application claims the priority benefit of U.S. application Ser. No. 10/913,669, filed Aug. 6, 2004 now U.S. Pat. No. 7,112,085, which claims the priority benefit of U.S. Provisional Application Ser. No. 60/523,449, filed Nov. 19, 2003.

FIELD OF THE INVENTION

This invention relates to an electrical switch and lamp assembly which includes at least one insulation displacement connector for making electrical contact with insulated wires attached to the switch.

BACKGROUND

There are places where a rather thin switch and lamp assembly is desirable. An example is with a vanity mirror mounted in a sun visor on an automobile. A lamp to illuminate the user is common, and these may be turned on and off by a switch actuated by movement of the vanity mirror cover. It is desirable that such mechanisms be kept as thin as possible so that the total thickness of the sun visor is minimized.

It is found that using an insulation displacement connector for making electrical connections to the lamp and switch assembly is quite desirable. Insulation displacement connectors (commonly referred to as IDC's) have been known at least as early as 1961. As shown in U.S. Pat. No. 3,012,219. These are widely used for making telephone connections, for example, Such connections have been used on electrical switches as well. Better ways of implementing and making connections to a switch or the like with an IDC are desirable to make the assembly process simpler and more efficient.

BRIEF DESCRIPTION OF THE INVENTION

There is therefore provided in practice of this invention an insulation displacement connector adjacent a wire-receiving groove in an insulating base. An insulation displacement connector has a fixed end secured on the base and a movable end with an insulation displacement slot on an end of the connector transverse to the length of the groove. The movable end is cantilevered from the fixed end. The movable end of the connector is retained in a position with the slot moved toward the bottom of the groove to make electrical connection with a wire in the groove.

A lamp and switch with an insulation displacement connector has a pair of wire receiving grooves in an insulating base and a pair of upstanding walls straddling each of the grooves. A pair of metal connector members each have a fixed end secured to the base. A movable end on such a connector includes an insulation displacement slot extending in a director transverse to the groove in the base. A switch contact extends from a fixed end on one of the connectors. The lamp is mounted on the base with a wire electrically connected to one of the connector members. The switch contact member is elastically deflectable between an open position away from the switch contact extension, and a closed position in engagement with it. The switch contacts are in approximately the same "plane" as the base. Each of the metal connector members has a pair of opposed ears on the movable end with the distance between the ends of the ears being greater than the distance between the upstanding walls. Thus, when the movable end is pressed against a wire in the groove, the wire is straddled by the slot and the ears plastically engage the walls to inhibit retraction of the slot away from the electrical connection.

BRIEF DESCRIPTION OF THE DRAWINGS

These and other features and advantages of the invention will be appreciated as the same becomes better understood by reference to the following description when considered in connection with the accompanying drawings wherein.

DETAILED DESCRIPTION

Figure 1:
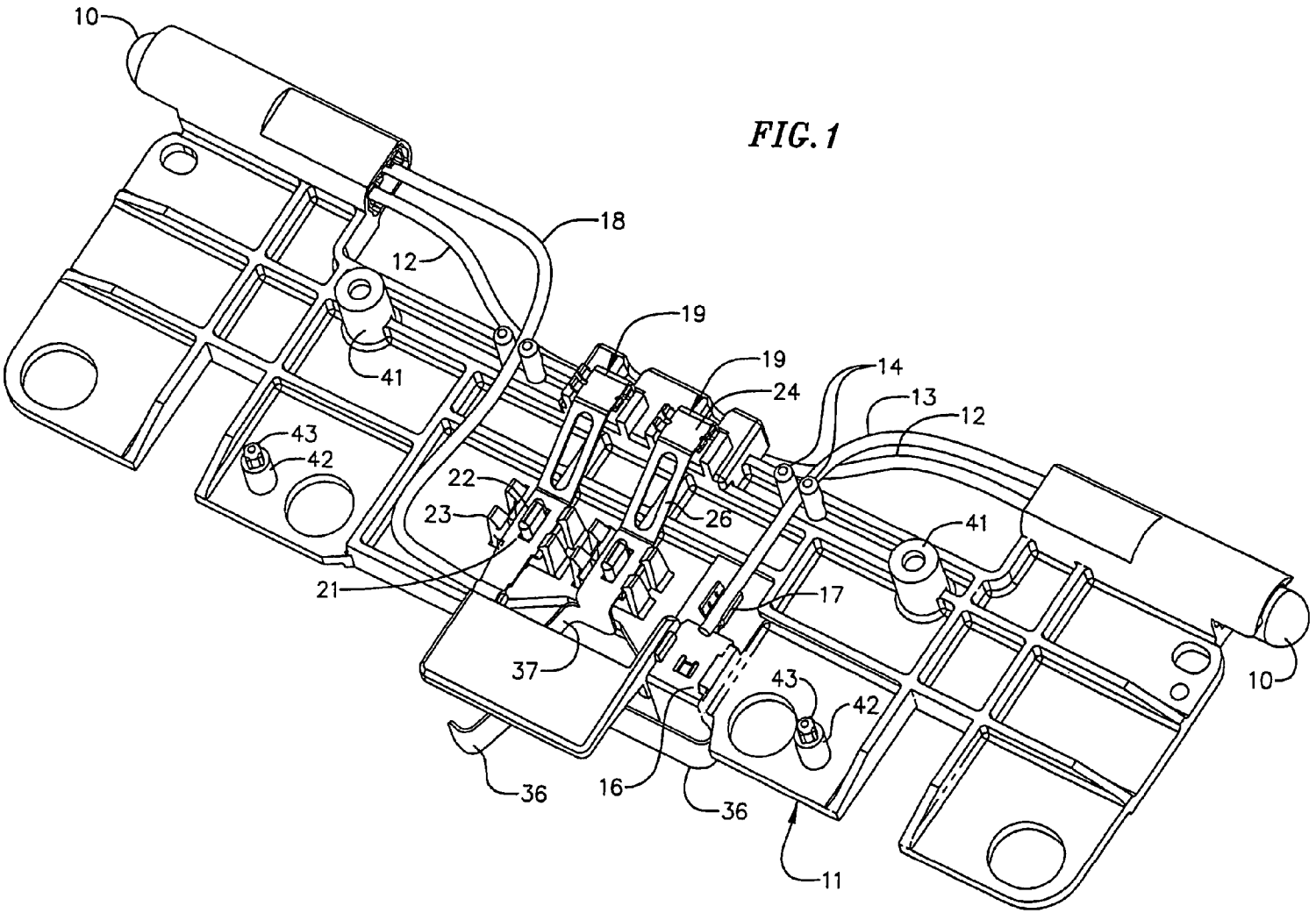
FIG. 1 illustrates in perspective a lamp, switch and insulation displacement connector assembly.

A switch and two serially connected incandescent lamps 10 are mounted on an elongated insulating base 11 which is typically made of injection molded plastic. The base includes a number of reinforcing ribs, mounting holes and the like, which are illustrated but need not be described for an understanding of the invention. Such mounting arrangements may be different when such an assembly is used in a context different from the one for which the illustrated assembly is best suited.

In this embodiment, the lamps are connected in series by an insulated wire 12. Another insulated wire 13 from one of the lamps passes between a pair of support posts 14 and is connected to a metal pad 16. (For convenience of illustration, the end of the wire 13 is shown without the insulation stripped from the end. Also, the conventional crimp-type fastener 17 on the pad is shown open to receive the stripped wire before crimping. The crimps are closed in the process of manufacturing and before shipping the assembly to the customer.) The second wire from another lamp is similarly mounted via a crimped connection to one of a pair of insulation displacement connectors 19 (IDC's).

The two IDC's are generally similar and only one needs to be described. In fact, in the enlarged fragmentary view of FIG. 2, one of the IDC's has been deleted to better show part of the base and how an external connection is made to the IDC. Each IDC is an elongated metal sheet (e.g. phosphor bronze) which has a fixed end 21 is secured to the base. An elongated hole through the fixed end fits over an alignment stud 22 on the base. Upturned edges of the fixed end fit down between four slightly flexible fingers straddling the fixed end. Small hooks on the ends of the fingers engage the upturned edges and permanently secure the fixed end to the base. (During assembly, the fixed end is merely pushed down around the alignment post, thereby deflecting the fingers which then snap back to engage the upturned edges).

The other end 24 of the IDC is movable toward and away from the base since it is connected to the fixed end by a narrowed center section 26, which is easily flexed. Thus, the IDC is essentially in the form of a cantilever fixed at only one end. The center section is preferably narrowed by a central opening to make that portion of the IDC easier to bend.

Figure 3:
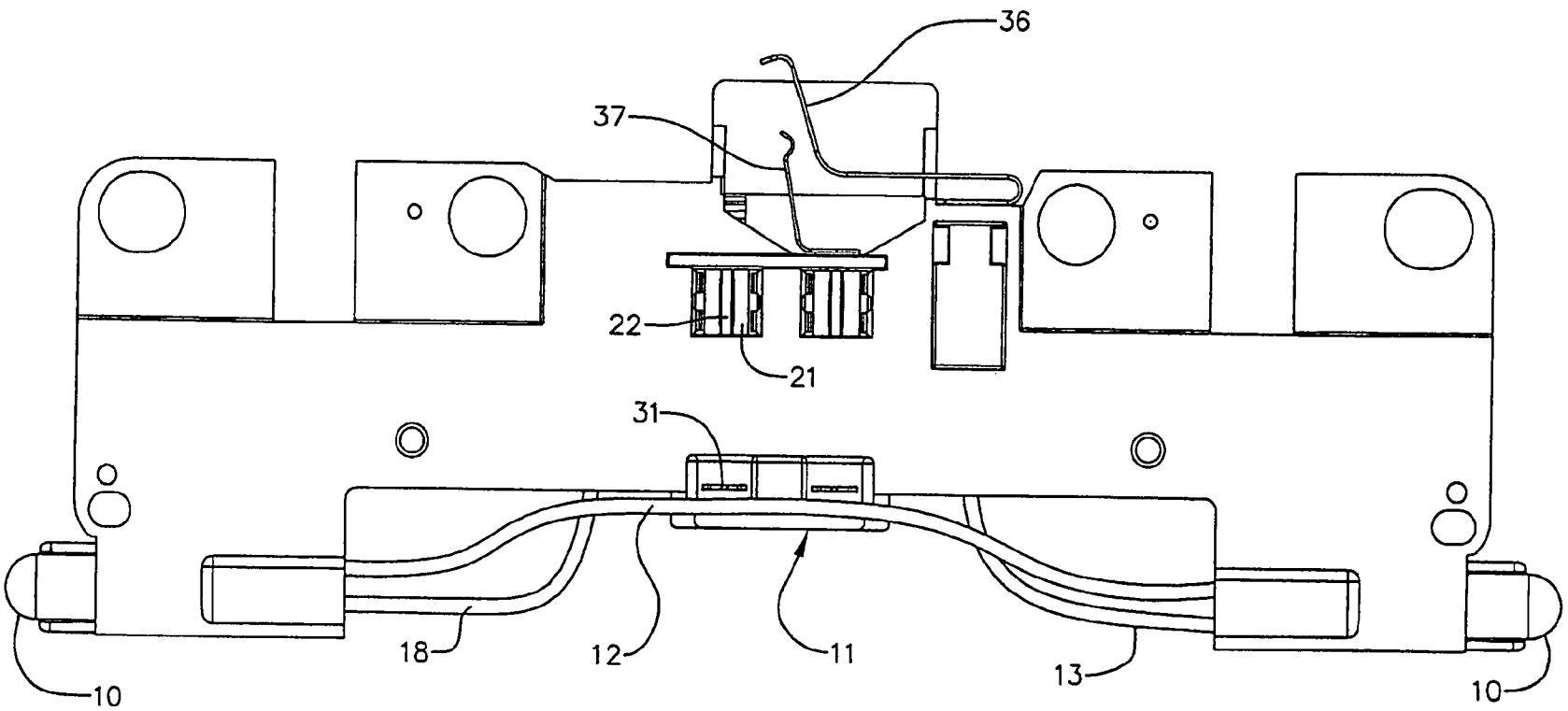
FIG. 3 is a bottom view of the assembly.

The movable end of the IDC is bent in an L-shape to have a portion extending transverse to a rounded wire-receiving groove 27 in the base. (The groove could be V-shaped, if desired.) This bent portion has a pair of tines defining a central slot 28 therebetween. For ease of description, it is assumed that the bottom view of FIG. 3 is down. Thus, when the IDC is flexed toward the base it moves "downwardly". It will be recognized that this is merely useful for purposes of description and that the assembly may be oriented in any direction.

Figure 2:
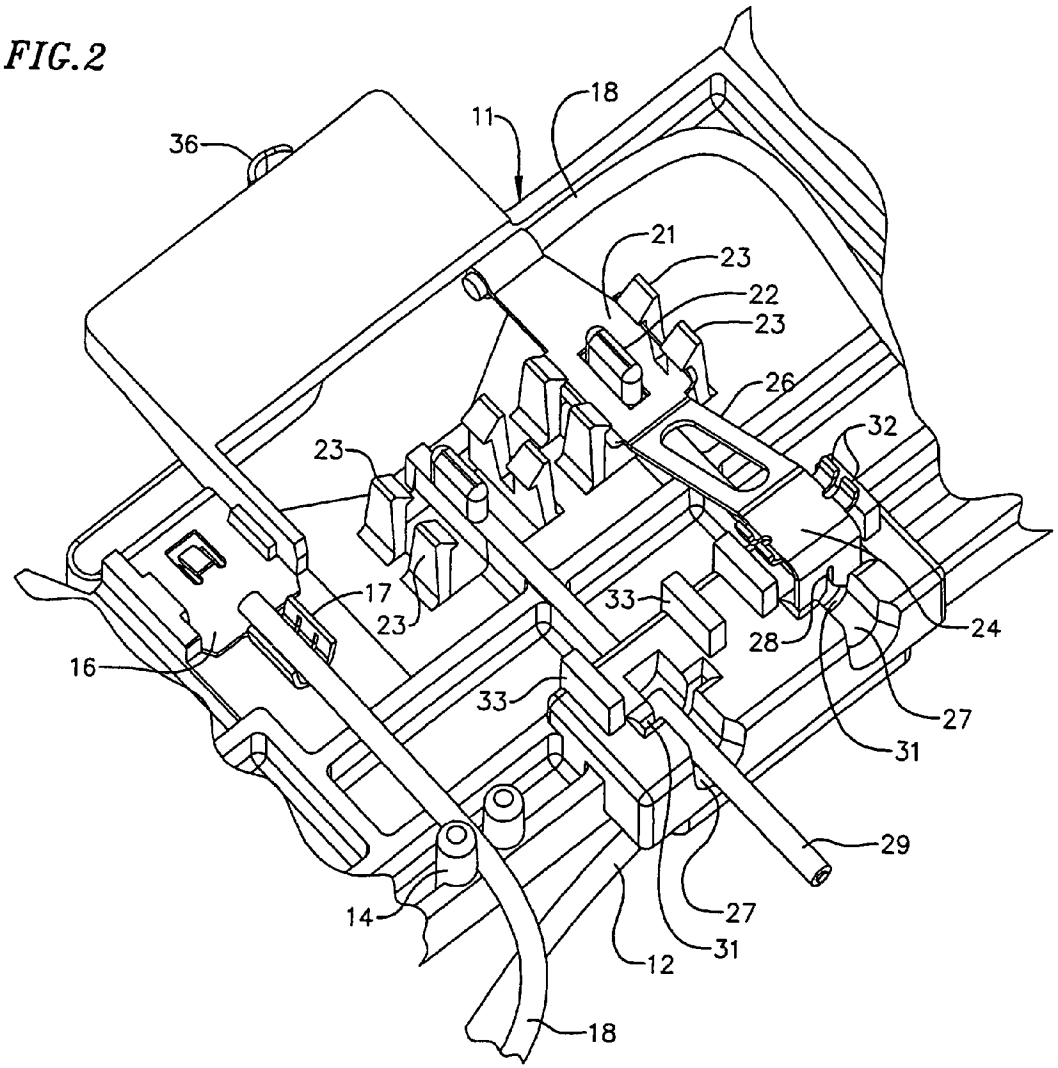
FIG. 2 illustrates is a fragmentary perspective view of a part of the assembly with one of the insulation displacement connectors removed.

To make an electrical connection to an external wire, an insulated wire such as the wire 29 illustrated in FIG. 2 is laid in the groove and the movable end of the IDC is pressed downwardly so that the tines straddle the wire, displace the insulation, and make electrical contact with the metal wire. -A clearance or guide opening 31 extending through the base provides clearance for the tines on the movable end of the IDC. The width of the opening is only slightly wider than the thickness of the sheet forming the tines so that the wire is supported as the tines move down straddling it. When the IDC is pressed downwardly in engagement with the wire, the sheet is nearly flat; that is, the fixed and movable ends are nearly in the same plane. This helps minimize the thickness of the assembly.

The downward motion of L-shaped end of the cantilever arm is guided by the slot 31 in the adjacent plastic base for minimized tendency toward twisting and to assure travel in a direction normal to the principal length of the IDC, i.e., in a direction parallel to the slot in the free end. The central weakened section of the cantilever arm permits the L-shaped free end of the arm to move "vertically" downwardly by buckling or bending the arm upwardly in its mid-portion. Otherwise the L-shaped end would move in an arc as the cantilever arm bends. The mid-portion of the sheet is more readily bendable than the principal balance of the sheet because of the longitudinal slot.

The length of the opening 31 in the base which receives the movable end of the IDC is only a little more than the width of the sheet making the tines on the end of the IDC. The tines extend a little ways into the opening, thereby providing guidance for the end of the IDC as it is moved downwardly to a wire-engaging position. This contributes to making the IDC insensitive to off-center application of closing forces.

The movable end of the IDC has four ears 32 in pairs on opposite edges of the movable end. It will be noticed that the ears are bent upwardly from the movable end so that they are rounded or angled diagonally on the bottom face and have a relatively sharp non-rounded edge aligned upwardly. (In fact, it is helpful that a slight burr is often present on the outer non-rounded edge of the ears due to stamping the sheet metal part.) When the IDC is pressed down onto the wire, the ears pass between a pair of upstanding walls 33 on the base. The distance between the edges of the ears is slightly larger than the distance between the walls, so that as the metal moves down, it may plastically deform the walls. However, the non-rounded edges of the ears would dig into the plastic if the movable end were to move upwardly, and they, therefore, act as a pawl with the walls acting as a ratchet to hold the movable end down against the wire.

To make electrical connections to the lamp and switch assembly one simply inserts an insulated wire into the groove underlying the movable end of the IDC. Ordinarily, the assembler inserts a pair of wires into the respective grooves until they engage plastic body at the far end of the grooves. The movable end of the IDC is then pressed downwardly toward the base and the tines on each side of the slot in the IDC displace insulation from the wire and make electrical contact with the wire. Again, the assembler ordinarily presses both IDC's down simultaneously. The top of the plastic body engaging the underside of the IDC arm forms a stop defining the maximum bending of the IDC arm. As the movable end is pressed downwardly toward the base the ears on each edge scrape along the plastic of the opposing walls and may displace some of the plastic. Because of this, when the force pressing the movable end into electrical contact with the wire is released, the non-rounded edges of the ears dig into the plastic of the walls and hold the tines on each edge of the slot in continued engagement with the wire. Thus, the ears and walls act as a ratchet to permit downward movement of the movable end and preventing upward movement.

As best seen in FIGS. 1 and 3, there is a generally "L" shaped switch contact member 36 formed integrally with the electrical contact pad 16. A switch contact extension 37 is formed integrally with the fixed end of one of the IDC's. The switch formed by these two contacts is closed when an external actuator (not shown) deflects the longer switch contact member 36 to come into engagement with the switch contact extension on one of the IDC's. Such an external actuator may, for example, be part of a cover over a vanity mirror on an automobile sun visor. With the switch closed, current can flow, for example, from an external wire to the IDC connected to the shorter switch contact extension 37 then through the longer switch contact member 36 to the pad 16. Current flows from there serially through the two lamps to the other IDC to which a second external wire is connected.

The arrangement of switch contacts operable by pressing laterally toward the base contributes to the "thinness" of the assembly. These switch contacts lie in approximately the same "plane" as the plastic base of the assembly. The assembly is basically flat, but not planar since it has varying thickness in different areas. For example, the total thickness when the IDC's are down and engaged with wires is only slightly more than 0.3 inch. Thus, by lying in the same "plane", it is meant that the switch contacts do not protrude significantly above or below the plastic base. (In the illustrated embodiment, the switch contacts actually extend a small distance below the largest flat surface of the bottom of the base and only some small areas of the base extend as far as the maximum extension of the switch contacts.) Similarly, the IDC's are approximately in the same "plane" as the base when engaged with a wire. Before engagement, the movable ends of the IDC's are about ⅜ inch above the bottom of the base, but when pressed down, they are within the 0.3 inch thickness.

The external electrical connections can be made to the assembly either before or after it is mounted in the place where it is to be used. The external connections can be made before mounting since when an IDC is used with the appropriate size of wire the IDC securely engages the wire and successfully resists normal handling.

No special tools are needed for engaging the IDC's with the respective external wires. Almost anything the right size can be used to press the movable end into engagement with the external wire. Simple finger pressure may be used, although the cantilever in an exemplary embodiment is stiff enough that finger pressure is not suitable for use on a production line. A small "U" shaped manual or pneumatic tool may be used, if desired, to press the IDC's into engagement with the respective wires simultaneously. Simultaneous engagement is desirable to avoid inadvertently pressing one of the IDC's downwardly before a wire is in place.

The IDC's employed in this assembly differ significantly from anything previously known. The cantilever IDC is flexed in the center section 26 and then latched in place by the ears engaging the walls. It may be noted that the walls engaging the ears also serve as a guide to assure that the slot remains centered over the wire. The wire is centered because it lies in a round bottom (or V-shaped) groove and also because there is a V-shaped throat at the open end of the slot.

Referring back to FIG. 2, it will be noted that the opening 31 through the base has a length greater than the width of the groove. The tines defining the IDC slot in the movable end are partly encompassed by this opening. This serves to guide the movable end of the IDC. As mentioned before, it is a benefit of the IDC that the direction of force tending to close the IDC into engagement with a wire is not critical. The guiding opening 31 encompassing a part of the movable end of the IDC assures that misalignment is not a problem.

There is one feature of interest in the area of the base illustrated in FIG. 1 beyond the central portion where the IDC's are located. There are a pair of hollow bosses 41 standing above the principal portion of the base and effectively at the upper face of the "plane" of the base. A second pair of bosses 42 each have a small stud 43 on top. When the assemblies are completed, one assembly is inverted over another and the studs are pressed into the holes in the hollow bosses for temporarily holding the two assemblies together. The snapped together assemblies protect the more sensitive parts from damage during shipping and are easily popped apart by the customer for installation.

Although one embodiment of the IDC, a lamp and switch assembly has been described and illustrated herein it will be apparent that there are variations that can be made embodying the principles of this invention. For example, in this embodiment the movable end of the IDC is latched into engagement with the wire by an opposing pair of ears. A single ear or pair of ears extending from the movable end 90° from the location illustrated, may engage a surface on the base which is also 90° from the opposing faces of the walls on the base. In other words, the ear or ears would stick out in the same direction as the length of the IDC illustrated. Other ways of narrowing the center portion of the cantilever for ease of flexing will be apparent. Electrical connections between the IDC's and switch contacts may differ. Clearly, details of the base will differ for different applications. An IDC as described may be used in quite a different context than the assembly described and illustrated herein. Thus, within the scope of the following claims, the invention may be practiced differently from the embodiment illustrated and described in detail.

What is claimed is:

1. A lamp and switch with insulation displacement connectors comprising:

an insulating base;

a pair of wire-receiving grooves in the base;

a pair of parallel cantilever insulation displacement connector members each having a fixed end secured to the base and a movable end including an insulation displacement slot extending in a direction transverse to the respective groove in the base;

means on the base for holding the movable end of each connector member in engagement with a wire in a respective groove;

at least one lamp mounted on the base; and switch contacts on the base electrically connected to a fixed end of one of the connector members and the lamp, respectively.

2. A lamp and switch with insulation displacement connectors according to claim 1 wherein the base comprises a plurality of raised fingers and the fixed end of each insulation displacement connector is between a pair of such fingers.

3. A lamp and switch with insulation displacement connectors according to claim 1 comprising:

slightly flexible fingers on the base straddling the fixed end of each of the insulation displacement connectors;

an alignment stud on the base; and an elongated hole through the fixed end of each insulation displacement connector fitted over the alignment stud.

4. A lamp and switch with insulation displacement connectors according to claim 1 wherein the means for holding comprises a pair of opposed ears on the movable end of each of the connector members and opposing surfaces on the base engaging the ears.

5. A lamp and switch with insulation displacement connectors according to claim 1 wherein the base includes a guide opening encompassing a part of the movable end including the slot.

6. A lamp and switch with insulation displacement connectors according to claim 5 wherein the guide opening constrains the movable end to move in a direction parallel to the slot.

7. A lamp and switch with insulation displacement connectors according to claim 1 wherein each connector member comprises a flexible narrowed center portion between the fixed end and the movable end.

8. A lamp and switch with insulation displacement connectors comprising:

an insulating base;

a pair of wire-receiving grooves in the base;

a pair of upstanding walls straddling each of the grooves;

a pair of metal connector members each having a fixed end secured to the base and a movable end including an insulation displacement slot extending in a direction transverse to the groove in the base;

a switch contact extension on the fixed end of one of the connectors;

a lamp mounted on the base;

a first wire electrically connected between the lamp and one of the connector members;

a switch contact member including a portion deflectable between an open position away from the switch contact extension and a closed position engaging the switch contact extension;

a second wire electrically connected between the lamp and the switch contact member; and a pair of opposed ears on the movable end of each of the connector members, the distance between the ends of the ears being greater than the distance between the upstanding walls.

9. A lamp and switch with insulation displacement connectors according to claim 8 further comprising a second lamp in series with the first lamp, the second lamp forming part of the electrical connection between the first lamp and the connector member.

10. A lamp and switch with insulation displacement connectors according to claim 8 wherein each connector member comprises a flexible center portion between the fixed end and the movable end.

11. A lamp and switch with insulation displacement connectors according to claim 8 wherein the base comprises a guide opening encompassing a part of the movable end portion having the slot.

12. A lamp and switch with insulation displacement connectors comprising:

an elongated insulating base with a pair of wire-receiving grooves;

a pair of serially connected lamps mounted on the base;

a pair of cantilivered insulation displacement connector members, each having a fixed end secured to the base, a movable end including an insulation displacement slot extending in a direction transverse to the groove in the base, and a flexible center portion between the fixed and movable ends;

a switch contact extension on the fixed end of a first one of the connector members;

a switch contact member including a portion elastically deflectable between an open position away from the switch contact extension and a closed position engaging the switch contact extension;

electrical connections between the lamps, switch contacts and insulation displacement connector members; and means for holding the movable end of each of the insulation deflection members in approximately the same "plane" as the base.

13. A lamp and switch with insulation displacement connectors according to claim 12 wherein the switch contact extension and the switch contact member are each in approximately the same "plane" as the base.

14. A lamp and switch with insulation displacement connectors according to claim 12 wherein the means for holding comprises a pair of opposed ears on the movable end of each of the connector members, opposing surfaces on the base engaged by the ears when the movable end is approximately in the same "plane" as the base.

* * * * *